US006237149B1

(12) United States Patent
MacDonald

(10) Patent No.: US 6,237,149 B1
(45) Date of Patent: May 29, 2001

(54) LOWER LEG PROTECTION MEANS

(76) Inventor: Stephen J. MacDonald, 5527 - 20th St. South, Fargo, ND (US) 58104

( * ) Notice: Subject to any disclaimer, the term of this patent is extended or adjusted under 35 U.S.C. 154(b) by 0 days.

(21) Appl. No.: 09/427,766

(22) Filed: Oct. 28, 1999

(51) Int. Cl.[7] ..... A41D 13/00
(52) U.S. Cl. ..... 2/22; 2/24; 602/23
(58) Field of Search ..... 2/22, 24, 23, 455, 2/456, 16, 20, 453; 602/23, 26, 20, 16

(56) References Cited

U.S. PATENT DOCUMENTS 2,817,841 * 12/1957 Bilecki ..... 2/22
3,772,704 * 11/1973 Carbonneau ..... 2/22
4,627,108 * 12/1986 Jarvinen ..... 2/22
4,633,529 * 1/1987 Litz ..... 2/22
4,888,826 * 12/1989 Parsons, Jr. et al. ..... 2/22
5,297,294 * 3/1994 Washick ..... 2/22
5,301,370 * 4/1994 Henson ..... 2/22
5,452,475 * 9/1995 Hunt, Jr. ..... 2/22
5,477,559 * 12/1995 Clement ..... 2/22
5,507,720 * 4/1996 Lampropoulos ..... 602/27
5,561,857 * 10/1996 Hoshizaki et al. ..... 2/22
5,652,956 * 8/1997 Hoshizaki et al. ..... 2/22
5,711,028 * 1/1998 Bourque et al. ..... 2/22
5,732,411 * 3/1998 Coleman et al. ..... 2/22
5,742,938 * 4/1998 Winningham et al. ..... 2/22

* cited by examiner

*Primary Examiner*—Gloria M. Hale
(74) *Attorney, Agent, or Firm*—John J. Leavitt

(57) ABSTRACT

A lower leg protection means for preventing injury to a person's lower leg. The lower leg protection means includes a pair of thin, laterally curved rigid members which are enclosed with foam material such as polyfoam and which are essentially made of carbon fiber graphite. Each of the thin, laterally curved rigid members is fastened about a particular region of a person's lower leg with fasteners which includes a three first strips of hook and loop fasteners, a pair of elongate elastic members, and a pair of second strips of hook and loop fasteners attached to the elongate elastic members. One of the thin, laterally curved, padded rigid members is adapted to fit about and protect a person's shin, and the other of the thin, laterally curved, padded rigid members is adapted to fit about and protect a person's Achilles tendon.

12 Claims, 2 Drawing Sheets

LOWER LEG PROTECTION MEANS

BACKGROUND OF THE INVENTION

1. Field of the Invention

The present invention relates to means for protecting a person's shin and Achilles tendon and more particularly pertains to a new lower leg protection means for preventing injury to a person s lower leg.

2. Description of the Prior Art

The use of means for protecting a person's shin and Achilles tendon is known in the prior art. More specifically, means for protecting a person's shin and Achilles tendon heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,744,384; U.S. Pat. No. 2,609,537; U.S. Pat. No. 2,818,571; U.S. Pat. No. 4,325,148; U.S. Pat. No. 4,453,271; and U.S. Pat. No. 4,512,037.

While these devices fulfill their respective, particular objectives and requirements, the aforementioned patents do not disclose a new lower leg protection means. The inventive device includes a pair of thin, laterally curved rigid members which are enclosed with foam material such as polyfoam and which are essentially made of carbon fiber graphite. Each of the thin, laterally curved rigid members is fastened about a particular region of a person's lower leg with fasteners which includes a pair of first strips of hook and loop fasteners, a pair of elongate elastic members, and a pair of second strips of hook and loop fasteners attached to the elongate elastic members. One of the thin, laterally curved, padded rigid members is adapted to fit about and protect a person's shin, and the other of the thin, laterally curved, padded rigid members is adapted to fit about and protect a person's Achilles tendon.

In these respects, the lower leg protection means according to the present invention substantially departs from the conventional concepts and designs of the prior art, and in so doing provides an apparatus primarily developed for the purpose of preventing injury to a person's lower leg.

SUMMARY OF THE INVENTION

In view of the foregoing disadvantages inherent in the known types of means for protecting a person's shin and Achilles tendon now present in the prior art, the present invention provides a new lower leg protection means construction wherein the same can be utilized for preventing injury to a person's lower leg.

The general purpose and object, of the present invention, which will be described subsequently in greater detail, is to provide a new lower leg protection means apparatus and method which has many of the advantages of the means for protecting a person's shin and Achilles tendon mentioned heretofore and many novel features that result in a new lower leg protection means which is not anticipated, rendered obvious, suggested, or even implied by any of the prior art means for protecting a person's shin and Achilles tendon, either alone or in any combination thereof.

To attain this general purpose and object, the present invention generally comprises a pair of thin, laterally curved rigid members which are enclosed with foam material such as polyfoam and which are essentially made of carbon fiber graphite. Each of the thin, laterally curved rigid members is fastened about a particular region of a person's lower leg with fasteners which includes a pair of first strips of hook and loop fasteners, a pair of elongate elastic members, and a pair of second strips of hook and loop fasteners attached to the elongate elastic members. One of the thin, laterally curved, padded rigid members is adapted to fit about and protect a person's shin, and the other of the thin, laterally curved, padded rigid members is adapted to fit about and protect a person's Achilles tendon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the appended abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is another object of the present invention to provide a new lower leg protection means which may be easily and efficiently manufactured and marketed.

It is a further object of the present invention to provide a new lower leg protection means which is of a durable and reliable construction.

An even further object of the present invention is to provide a new lower leg protection means which is susceptible of a low cost of manufacture with regard to both materials and labor, and which accordingly is then susceptible of low prices of sale to the consuming public, thereby making such lower leg protection means economically available to the buying public.

Still yet another object of the present invention is to provide a new lower leg protection means which provides some of the advantages disclosed in the prior art, while simultaneously overcoming some of the disadvantages normally associated therewith.

Still another object of the present invention is to provide a new lower leg protection means for preventing injury to a person's lower leg.

Still yet another object of the present invention is to provide a new lower leg protection means that lasts longer and is better able to withstand kicks and other blows to one's lower leg region.

Even still another object of the present invention is to provide a new lower leg protection means that not only protects a person's shin but also protect a person's Achilles tendon unlike any of the prior art.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
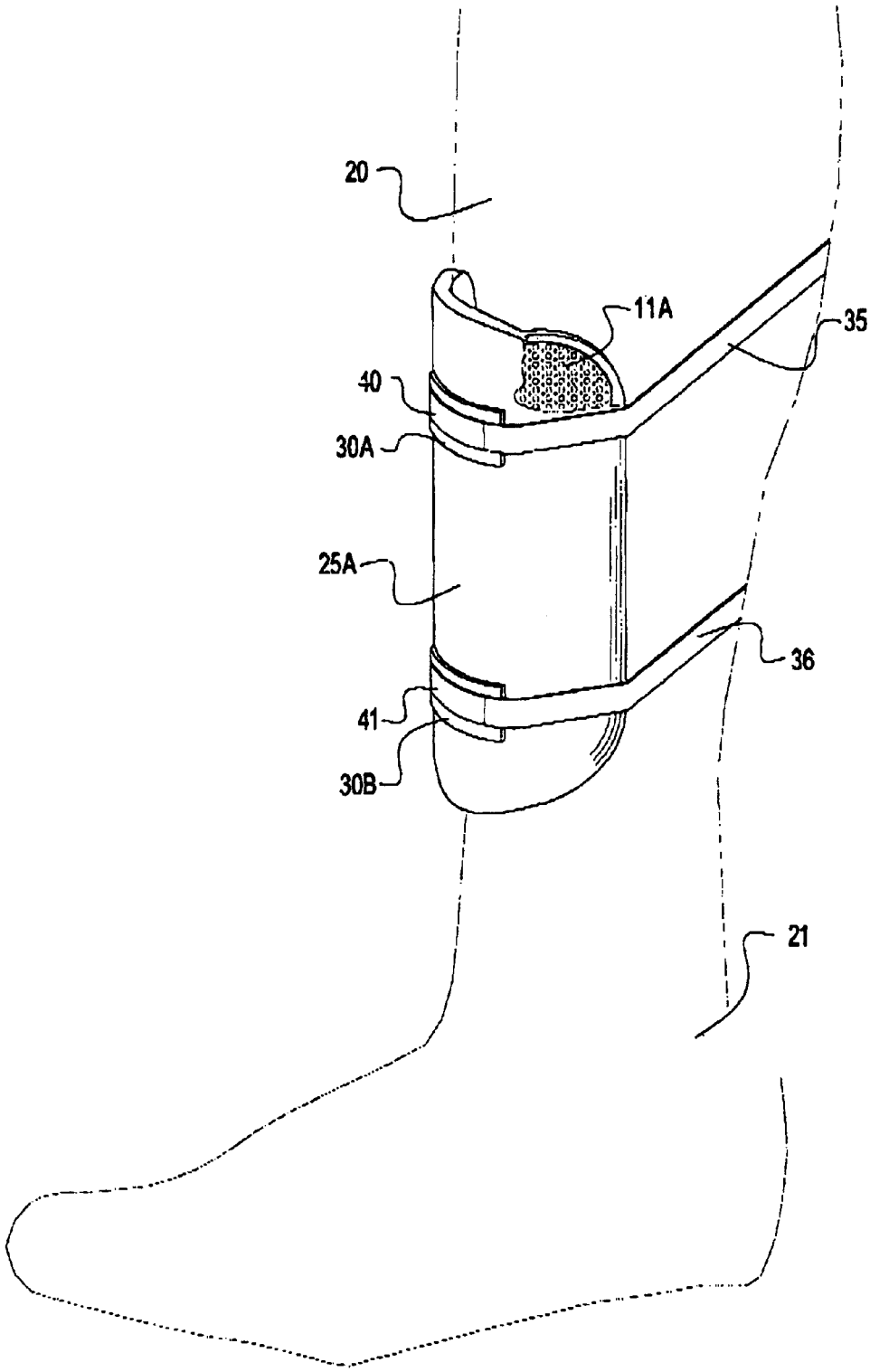
FIG. 1 is a perspective view of a new lower leg protection means according to the present invention.
Figure 2:
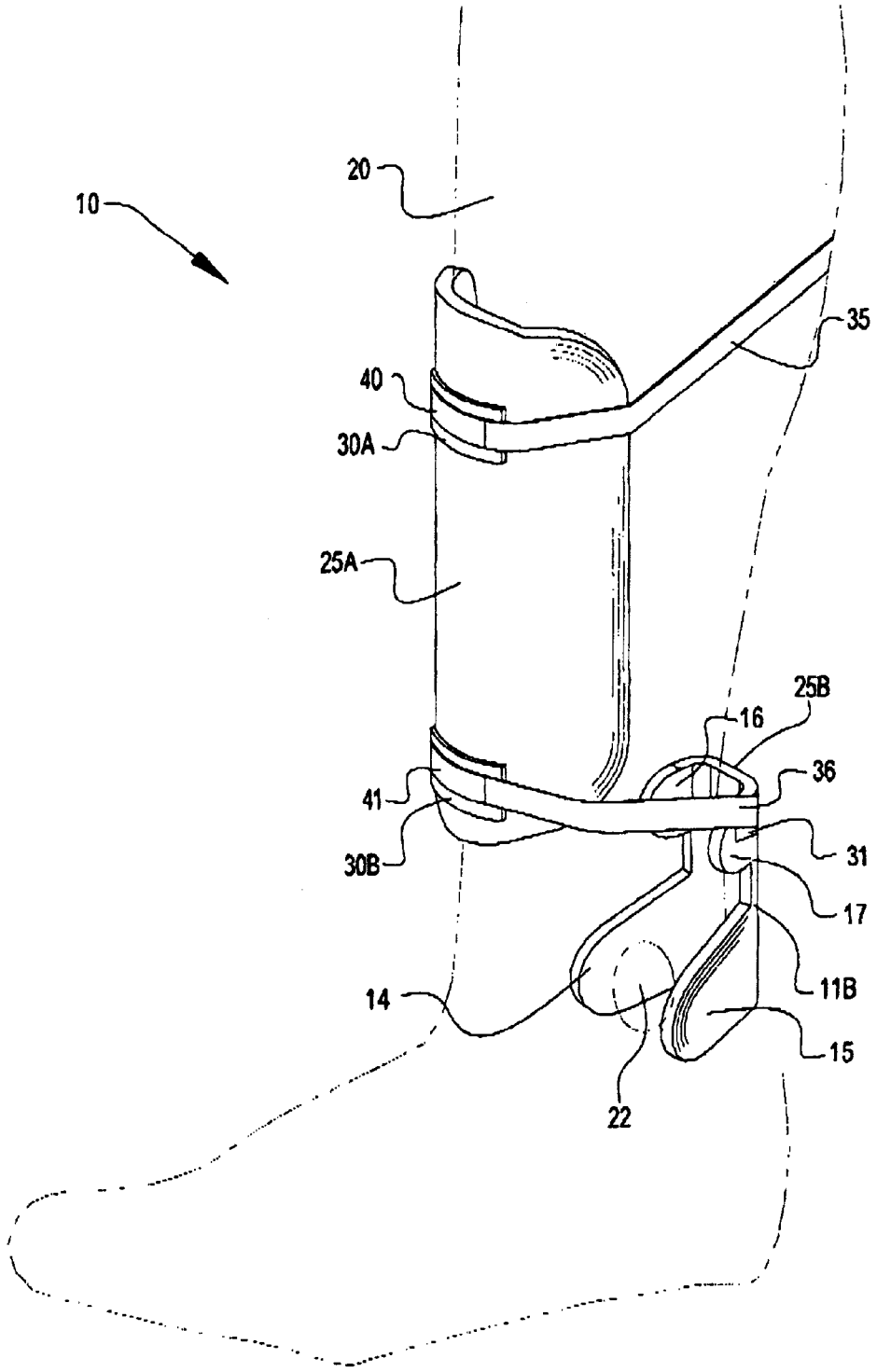
FIG. 2 is another perspective view of the new lower leg portion means of the present invention shown in position of use in cooperative association with an Achilles tendon protection means.

With reference now to the drawings, and in particular to FIGS. 1 through 2 thereof, a new lower leg protection means embodying the principles and concepts of the present invention and generally designated by the reference numeral 10 in FIG. 2 will be described.

As best illustrated in FIGS. 1 through 2, the lower leg protection means 10 generally comprises two thin, laterally curved rigid members 11A as seen in FIGS. 1 and 2 and 11B as seen in FIG. 2 and adapted to fit about and protect a portion of a person's lower leg. Each thin, laterally curved rigid member 11A and 11B is essentially made of carbon fiber graphite and further has a front side and a back side and is also essentially curved upon its back side with padding means 25A and 25B enveloped thereabout, i.e., enveloping the curved rigid member and being essentially made of foam material such as polyfoam. The padded thin, laterally curved rigid members 11A and 11B are fastened to a person's lower leg with a fastening means which includes three first strips 30A and, 30B (FIG. 1), 31 (FIG. 2) of hook and loop fasteners with two of the first strips 30A and 30B being securely and conventionally attached to the foam material upon the front exposed side of each of the thin, laterally curved rigid members 11A and the other of the first strips 31 being securely and conventionally attached to the foam material upon the front side of the other of the thin, laterally curved rigid members 11B as seen in FIG. 2. The fastening means further includes a pair of elongate elastic members 35,36 each having a first end securely and conventionally attached to a respective first strip 30A and 30B (FIG. 1), and also includes a pair of second strips 40,41 of hook and loop fasteners each being securely and conventionally attached along a second end of a respective elongate elastic member 35,36. One of the thin, laterally curved rigid members 11A is adapted to substantially fit over and protect the shin 20 of a person's lower leg. The other thin, laterally curved rigid member 11B is adapted to substantially fit over and protect the Achilles tendon 21 (FIG. 1) of a person's lower leg and has an upper portion and a lower portion, and further includes a left edge and a right edge. The upper portion includes a pair of tab-like projecting portions 16,17 one integrally extending from the left edge and the other integrally extending from the right edge. The tab-like projecting portions 16,17 are adapted to fit to either side of a person's ankle for essentially securing the thin, laterally curved rigid member 11B about the person's Achilles tendon 21. The lower portion includes a pair of enlarged projecting portions 14,15 one integrally extending from the left edge and the other integrally extending from said right edge. The enlarged projecting portions 14,15 are adapted to fit over and protect a person's Mallelous 22. The enlarged projecting portions 14,15 are angled slightly away from one another. Each of said enlarged projecting portions 14,15 has an outer edge which is substantially rounded.

In use, the person can either wear both thin, laterally curved rigid members 11A and 11B at the same time or wear one or the other as desired by the user. The lower leg protection means 10 is ideally suited especially for soccer players but can be worn also by other athletes in other sports such as football players where it has been noted that many of the athletes have torn their Achilles tendon in particular. The carbon fiber graphite is stronger than fiberglass or plastic and is just as light weight as fiberglass or plastic. There is no prior art which protects a person's Achilles tendon.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lower leg protection means comprising:

at least one thin, laterally curved rigid member adapted to fit about and protect a portion of a person's lower leg and further having a front side and a back side;

padding means enclosed about said at least one thin, laterally curved rigid member;

means for fastening said at least one thin, laterally curved rigid member to a person's lower leg;

said at least one thin, laterally curved rigid member is essentially made of carbon fiber graphite;

said at least one thin, laterally curved rigid member is essentially curved upon its back side;

said padding means is a foam material;

said fastening means includes a first strip of hook and loop fasteners securely attached to said foam material upon said front side of said at least one thin, laterally curved rigid member, and further includes an elongated elastic member having a first end securely attached to said strip, and also includes a second strip of hook and loop fasteners securely attached along a second end of said elongate elastic member;

said at least one thin, laterally curved rigid member includes a laterally curved member adapted to substantially fit over the Achilles tendon of a person's lower leg;

wherein said laterally curved member has an upper portion and a lower portion, and further includes a left edge and a right edge; and wherein said upper portion of said laterally curved member includes a pair of tab-like projecting portions one extending from said left edge and the other extending from said right edge, said tab-like projecting portions being adapted to fit to either side of a person's ankle for securing said laterally curved member about the person's Achilles tendon.

2. A lower leg protection means as described in claim 1, wherein said lower portion of said laterally curved member includes a pair of enlarged projecting portions one extending from said left edge and the other extending from said right edge, said enlarged projecting portions being adapted to fit over and protect a person's Mallelous.

3. A lower leg protection means as described in claim 2, wherein said enlarged projecting portions are angled slightly away from one another.

4. A lower leg protection means as described in claim 3, wherein each of said enlarged projecting portions has an outer edge which is substantially rounded.

5. A lower leg protection means comprising:

at least one thin, laterally curved rigid non-flexible member adapted to fit about and protect a portion of a person's lower leg and further having a convex front side and a concave back side;

padding means enveloping said convex front and concave back sides of said at least one thin, laterally curved rigid non-flexible member; and a means for detachably fastening said at least one thin, laterally curved padded rigid non-flexible member to a person's lower leg.

6. A lower leg protection means as described in claim 5, wherein said at least one thin, laterally curved rigid non-flexible member enveloped by said padding means is made of carbon fiber graphite.

7. A lower leg protection means as described in claim 6, wherein said at least one thin, laterally curved rigid member is essentially curved upon said back side.

8. A lower leg protection means as described in claim 7, wherein said padding means is a foam material.

9. A lower leg protection means as described in claim 8, wherein said fastening means includes a first strip of hook and loop fasteners securely attached to said foam material enveloped upon said convex front side of said at least one thin, laterally curved rigid member, and further includes an elongate elastic member having a first end securely attached to said first strip of hook and loop material, and also includes a second strip of hook and loop fasteners securely attached along a second end of said elongate elastic member.

10. A lower leg protection means as described in claim 9, wherein said at least one thin, laterally curved rigid non-flexible member includes an elongate curved member adapted to substantially fit over and conform to a shin of a person's lower leg without flexing.

11. A lower leg protection means as described in claim 9, wherein said at least one thin, laterally curved rigid non-flexible member includes a laterally curved member adapted to substantially fit over the Achilles tendon of a person's lower leg.

12. A lower leg protection means as described in claim 11, wherein said laterally curved member has an upper portion and a lower portion, and further includes a left edge and a right edge.

* * * * *